US011178494B2

(12) United States Patent
Zhao et al.

(10) Patent No.: US 11,178,494 B2
(45) Date of Patent: Nov. 16, 2021

(54) SOUND GENERATING DEVICE

(71) Applicant: Goertek Inc., Weifang (CN)

(72) Inventors: Guodong Zhao, Weifang (CN); Zedong Zheng, Weifang (CN); Peijun Li, Weifang (CN); Yaqian Ji, Weifang (CN)

(73) Assignee: Goertek Inc., Weifang (CN)

( * ) Notice: Subject to any disclaimer, the term of this patent is extended or adjusted under 35 U.S.C. 154(b) by 18 days.

(21) Appl. No.: 16/961,357

(22) PCT Filed: Dec. 24, 2018

(86) PCT No.: PCT/CN2018/123195

§ 371 (c)(1),
(2) Date: Jul. 10, 2020

(87) PCT Pub. No.: WO2019/137192

PCT Pub. Date: Jul. 18, 2019

(65) Prior Publication Data

US 2020/0351592 A1 Nov. 5, 2020

(30) Foreign Application Priority Data

Feb. 12, 2018 (CN) ..... 201810146456.7

(51) Int. Cl.
*H04R 9/06* (2006.01)
*H04R 9/02* (2006.01)

(52) U.S. Cl.
CPC ..... *H04R 9/06* (2013.01); *H04R 9/025* (2013.01); *H04R 2400/11* (2013.01)

(58) Field of Classification Search
CPC ..... H04R 9/06; H04R 9/025; H04R 2400/11; H04R 1/288; H04R 1/2811
See application file for complete search history.

(56) References Cited

U.S. PATENT DOCUMENTS

2014/0341418 A1* 11/2014 Kwong ..... H04R 1/2811 381/386
2017/0048600 A1* 2/2017 Pu ..... H04R 1/023
2017/0208386 A1* 7/2017 Yang ..... H04R 9/06
(Continued)

FOREIGN PATENT DOCUMENTS

CN 202310077 U 7/2012
CN 203301737 U 11/2013
(Continued)

OTHER PUBLICATIONS

International Search Report dated Mar. 26, 2019 in International Application No. PCT/CN2018/123195.

*Primary Examiner* — Tuan D Nguyen
(74) *Attorney, Agent, or Firm* — Baker Botts, LLP

(57) ABSTRACT

An embodiment of the present invention provides a sound generating device which comprises a housing, wherein a sound generating unit is mounted in the housing, a closed rear cavity is formed between the sound generating unit and the housing, and the sound generating unit is provided with a rear sound hole in communication with the rear cavity, wherein the sound generating unit comprises a magnetic circuit system, an expandable-capacity cavity being provided on the magnetic circuit system, and the expandable-capacity cavity acting as part of the rear cavity to increase a volume of the rear cavity.

19 Claims, 8 Drawing Sheets

(56) References Cited

U.S. PATENT DOCUMENTS

| | | | | |
|---|---|---|---|---|
| 2017/0303035 | A1* | 10/2017 | Anacleto, II | H04R 1/345 |
| 2019/0253788 | A1* | 8/2019 | Pierce | H04R 1/025 |

FOREIGN PATENT DOCUMENTS

| | | | |
|---|---|---|---|
| CN | 103750860 | A | 4/2014 |
| CN | 103957487 | A | 7/2014 |
| CN | 104811857 | A | 7/2015 |
| CN | 104983442 | A | 10/2015 |
| CN | 105249989 | A | 1/2016 |
| CN | 106031644 | A | 10/2016 |
| CN | 106535068 | A | 3/2017 |
| CN | 107661121 | A | 2/2018 |
| CN | 207835800 | U | 9/2018 |
| CN | 109984773 | A | 7/2019 |
| JP | 2007096843 | A | 4/2007 |

* cited by examiner

SOUND GENERATING DEVICE

CROSS-REFERENCE TO RELATED APPLICATIONS

This application is a National Stage of International Application No. PCT/CN2018/123195, filed on Dec. 24, 2018, which claims priority to Chinese Patent Application No. 201810146456.7, filed on Feb. 12, 2018 and Chinese Patent Application No. 201820043784.X, filed on Jan. 10, 2018, all of which are hereby incorporated by reference in their entireties.

TECHNICAL FIELD

The present disclosure relates to the technical field of electroacoustic conversion devices, and in particular to a sound generating device.

BACKGROUND

The sound generating device is an important component in electronic products, such as cell phone, and is used to convert electrical signals into acoustic signals. The development trend of the electronic products, such as cell phone, is to get thinner and thinner, and in order to achieve more functions, there are more and more components in the electronic products. Hence, the space reserved for the sound generating device is bound to become smaller and smaller. Furthermore, the electronic products are paying more and more attention to the user's music experience, so the sound generating device is required to have better sound quality.

In order to improve music experience effects, the sound generating device in the prior art installs a sound generating unit in a module housing with a volume. The sound generating unit comprises a unit housing, and a magnetic circuit system and a vibration system accommodated and fixed in the unit housing. A rear cavity is formed between the sound generating unit and the module housing. The larger the rear cavity, the lower the low-frequency resonance frequency of the product, thereby the low-frequency performance of the product is improved.

If the volume of the sound generating device of the existing structure is reduced, the volume of the rear cavity of the sound generating device is bound to be reduced. Therefore, it is necessary to provide a new sound generating device, which has a small volume and good performance to meet the development needs of electronic products.

SUMMARY

An object of the present invention is to increase the rear cavity to improve acoustic characteristics while miniaturizing the sound generating device.

According to an aspect of the invention, a sound generating device is provided. The sound generating device comprises a housing, wherein a sound generating unit is mounted in the housing, a closed rear cavity is formed between the sound generating unit and the housing, and the sound generating unit is provided with a rear sound hole in communication with the rear cavity; the sound generating unit comprises a magnetic circuit system, an expandable-capacity cavity being provided on the magnetic circuit system, and the expandable-capacity cavity acting as part of the rear cavity to increase a volume of the rear cavity.

Optionally, the rear sound hole is provided at least at a bottom position or a side position of the sound generating unit.

Optionally, the magnetic circuit system comprises a magnetic conductive yoke and a magnetic circuit portion mounted on an upper surface of the magnetic conductive yoke; a first hole is provided upward at a bottom center position of the magnetic conductive yoke, and a recessed groove communicating with the first hole is provided in the magnetic circuit portion; the first hole and the recessed groove together form the expandable-capacity cavity.

Optionally, the magnetic circuit portion comprises a central magnetic circuit portion and a side magnetic circuit portion, the central magnetic circuit portion comprising a central magnet and a central magnetic conductive plate provided above the central magnet;

the recessed groove is a blind hole disposed in the center magnet, or the recessed groove is formed by penetrating a magnet central hole disposed on the center magnet.

Optionally, a ratio of an opening volume of the center magnet to a volume of the center magnet before opening is less than or equal to 35%.

Optionally, a magnetic conductive plate central hole communicating with the magnet central hole is provided on the central magnetic conductive plate, the magnetic conductive plate central hole communicating the rear cavity and an inner space of the sound generating unit as the rear sound hole.

Optionally, the rear sound hole of the sound generating unit is provided with a breathable spacer;

the rear cavity is filled with a sound absorbing material;

a mounting groove recessed in a direction going distally from the magnetic conductive yoke is provided on a bottom surface of the central magnetic conductive plate, and the breathable spacer is mounted in the mounting groove.

the rear sound hole of the sound generating unit is provided with a breathable spacer.

The rear cavity is filled with a sound absorbing material.

Optionally, the housing is a straight cylinder structure with openings at two ends;

the sound generating unit further comprises a vibration system, the vibration system comprising a diaphragm and a voice coil fixed below the diaphragm, the diaphragm being fixed on an end surface of a first end opening of the housing;

the magnetic circuit system is disposed below the vibration system and fixed in the housing;

the housing comprises a first portion corresponding to the vibration system and the magnetic circuit system, and a second portion integrally extending downward from the first portion beyond a bottom surface of the magnetic circuit system;

a lower cover plate is mounted at a second end opening of the housing, and the rear cavity is formed among the second portion of the housing, the bottom surface of the magnetic circuit system, and the lower cover plate.

Optionally, an outer side of the magnetic circuit system is disposed in close contact with an inner wall of the housing.

Optionally, an inner wall of a first end of the housing is provided with a convex edge extending toward a center of the housing, and an upper edge of the magnetic circuit system abuts and is fixed on a lower surface of the convex edge.

Optionally, the housing is of a rectangular structure.

Optionally, the lower cover plate is provided with a filling hole for filling the sound absorbing material, and a cover sheet is encapsulated on the filling hole.

Optionally, the cover sheet is provided with air-permeable micro-holes that allow air to pass and do not allow the sound absorbing material to pass; or, the cover sheet is provided with a leak hole, and the leak hole is covered with a first damping mesh that allows air to pass and does not allow the sound absorbing material to pass.

Optionally, the lower cover plate is made of metal.

Optionally, the lower cover plate is of a flat plate shape; or, the lower cover plate is of a bowl-shaped structure provided with a bottom wall and a side wall.

Optionally, the lower cover plate is adhered to an end surface of the second end opening of the housing by a strand layer; or an inner side of the end surface of the second end opening of the housing is provided with a recessed second step end surface, the second step end surface being provided with a top surface and side surfaces for mounting the lower cover plate; the lower cover plate is of a flat plate shape, an edge of the lower cover plate is provided with a recessed portion recessed toward the rear cavity, the recessed portion abuts on the top surface of the second step end surface and forms a first holding strand groove between the side surfaces of the second step end surface, and the first holding strand groove is coated with strands to fix the lower cover plate on the housing; or, the lower cover plate is of a bowl-shaped structure provided with a bottom wall and a side wall, an end of the side wall of the lower cover plate is bent outward to provide a mounting edge, the mounting edge abuts on the top surface of the second step end surface and forms a second holding strand groove between the side surfaces of the second step end surface, and the second holding strand groove is coated with strands to fix the lower cover plate on the housing; or a plastic edge is injection-molded on a periphery of the lower cover plate, and the plastic edge is ultrasonically welded to the second end opening of the housing.

Optionally, the diaphragm comprises a central portion and a folded ring portion disposed around the central portion, a breathable hole is provided in the central portion, and the breathable hole is covered with a second damping mesh, the second clamping mesh being made of a waterproof breathable material.

Optionally, the second damping mesh is made of a sound-impermeable material.

In the technical solution provided by the embodiments of the present invention, the expandable-capacity cavity is provided on the magnetic circuit system, which can effectively increase the volume of the rear cavity, help to achieve miniaturization of the product, and can improve the acoustic performance of the sound generating, device; further, it can also ensure the thickness of the magnet in the magnetic circuit system while increasing the volume of the rear cavity, to avoid the influence of high temperature on the magnetism of the magnet.

Other features and advantages of the invention will become clear from the following detailed description of exemplary embodiments of the invention with reference to the drawings.

BRIEF DESCRIPTION OF THE DRAWINGS

The drawings that form a part of the description describe embodiments of the invention; and together with the description serve to explain the principles of the invention.

DETAILED DESCRIPTION

Figure 1:
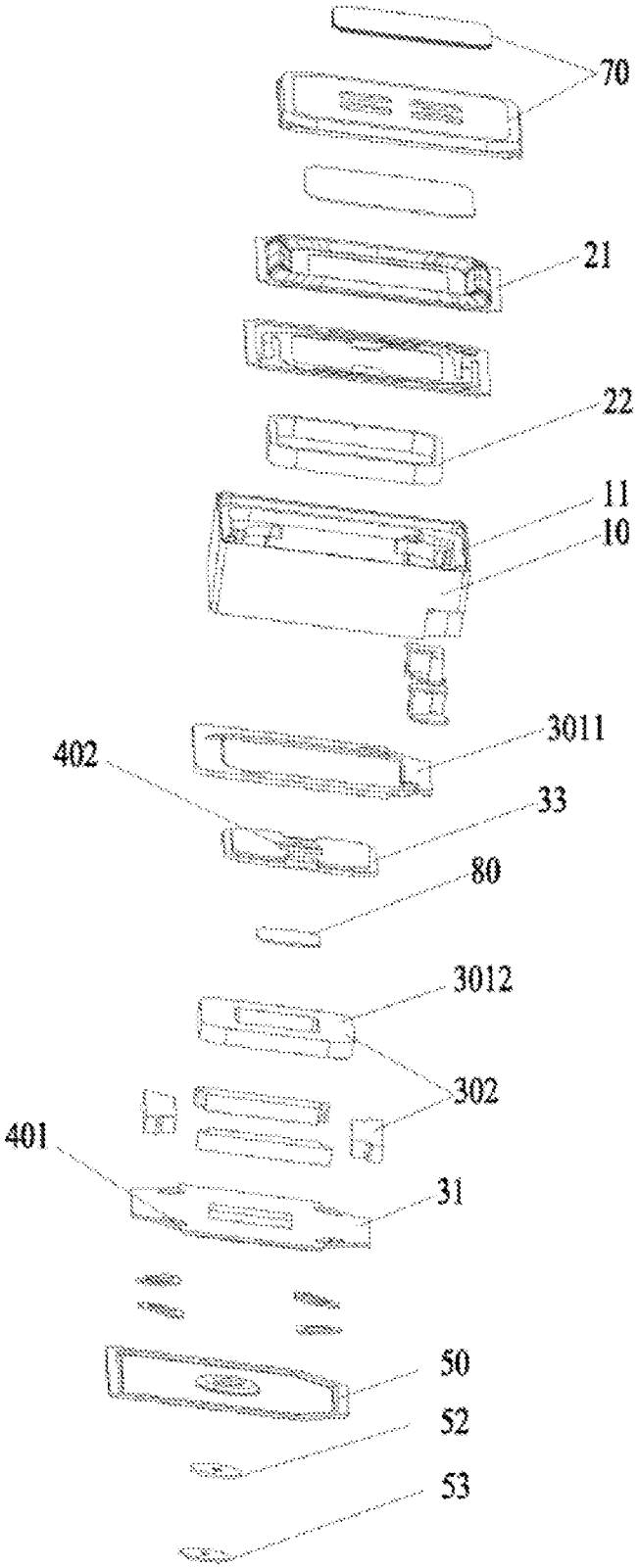
FIG. 1 is an exploded schematic view of a sound generating device provided by an embodiment of the invention

Various exemplary embodiments of the invention will now be described in detail with reference to the drawings. It should be noted that: unless specifically stated otherwise, the relative arrangement of components and steps, numerical expressions, and numerical values set forth in these embodiments do not limit the scope of the invention.

The following description of at least one exemplary embodiment is actually merely illustrative, and in no way serves as any limitation on the invention and its application or use.

Techniques and devices known to those of ordinary skill in the related art may not be discussed in detail, but where appropriate, the techniques and devices should be considered as part of the description.

In all examples shown and discussed herein, any specific values should be interpreted as exemplary only and not as limitations. Therefore, other examples of the exemplary embodiment may have different values.

It should be noted that: similar reference numerals and letters indicate similar items in the following drawings. Therefore, once an item is defined in one drawing, there is no need to discuss it further in subsequent drawings.

Figure 2:
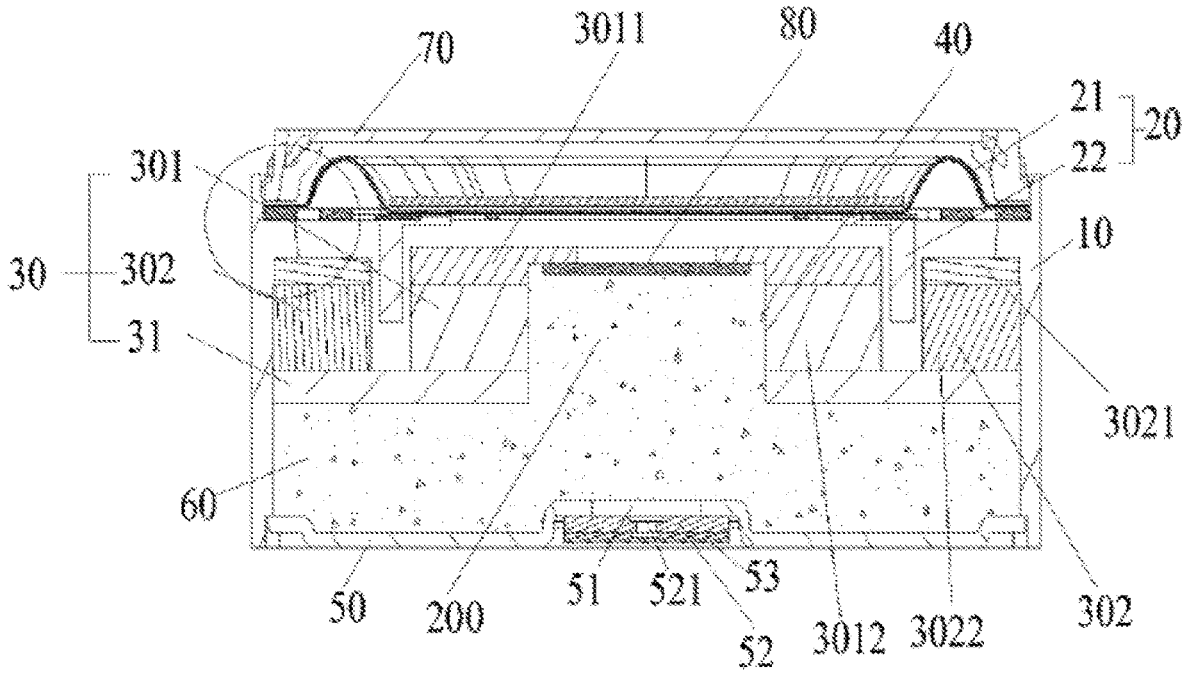
FIG. 2 is a schematic cross-sectional view of a sound generating device provided by an embodiment of the invention.
Figure 3:
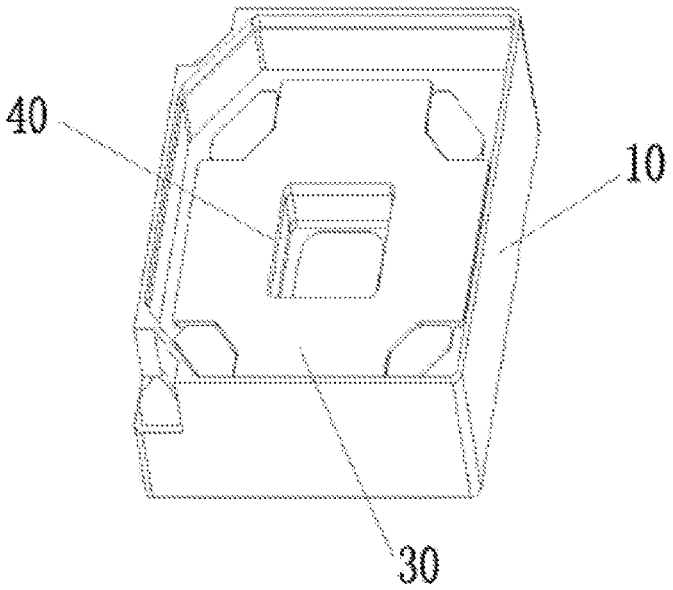
FIG. 3 is a schematic structural view of a specific implementation of a magnetic conductive yoke in a sound generating device provided by an embodiment of the invention.

FIG. 1, FIG. 2 and FIG. 3 show schematic structural views of a sound generating device provided by an embodiment of the invention. As shown in FIGS. 1 and 2, the sound generating device comprises a housing 10, wherein a sound generating unit is mounted in the housing 10, a closed rear cavity 60 is formed between the sound generating unit and the housing 10, and the sound generating unit is provided with a rear sound hole 40 in communication with the rear cavity 60. As shown in FIGS. 1 and 2, the sound generating unit comprises a magnetic circuit system 30, an expandable-capacity cavity 200 being provided on the magnetic circuit system 30, and the expandable-capacity cavity 200 acting as part of the rear cavity 60 to increase a volume of the rear cavity 60.

In the technical solution provided by the embodiments of the present invention, the expandable-capacity cavity is provided on the magnetic circuit system, which can effectively increase the volume of the rear cavity, help to achieve miniaturization of the product, and can improve the acoustic performance of the sound generating device; further, it can also ensure the thickness of the magnet in the magnetic circuit system while increasing the volume of the rear cavity, to avoid the influence of high temperature on the magnetism of the magnet.

In a specific embodiment, the first rear sound hole 401 is provided at least at the bottom position (as shown in FIG. 1) or the side position of the sound generating unit.

In a specific embodiment, as shown in FIG. 2, the magnetic circuit system 30 comprises a magnetic conductive yoke 31 and a magnetic circuit portion mounted on an upper surface of the magnetic conductive yoke 31; a first hole is provided upward at a bottom center position of the magnetic conductive yoke 31, and a recessed groove communicating with the first hole is provided in the magnetic circuit portion; the first hole and the recessed groove together form the expandable-capacity cavity 200.

In an achievable solution, as shown in FIGS. 1 and 2, the magnetic circuit portion comprises a central magnetic circuit portion 301 and a side magnetic circuit portion 302, the central magnetic circuit portion 301 comprising a central magnet 3012 and a central magnetic conductive plate 3011 provided above the central magnet 3012; the recessed groove is a blind hole disposed in the center magnet 3012, or the recessed groove is formed by penetrating a magnet central hole disposed on the center magnet 3012.

What needs to be added here is that the central area of the central magnet 3012 contributes to the BL of the sound generator (a parameter which measures the strength of the driving system in the sound generator) less than the boundary area. Therefore, when the volume of the rear cavity 60 is limited, the center area of the central magnet 3012 is hollowed-out to increase the volume of the rear cavity, which helps to improve the performance of the product. Although the hollowed-out area of the central magnet 3012 has little influence on the BL value of the magnetic circuit system, it still has some influence. If the hollowed-out area of the central magnet 30122 is too large, its influence on the BL value of the magnetic circuit system 30 cannot be ignored. If the hollowed-out area is too large, the BL value of the magnetic circuit system 30 will be smaller, and the performance of the product will be lower. Therefore, it is necessary to find a balance range such that the increase of the volume of the rear cavity 60 since the center magnet 3012 is hollowed-out improves the product performance more than the reduction in the BL value of the magnetic circuit system reduces the product performance, thereby optimizing the product performance. Through simulation, it is known that when the hollowed-out volume of the center magnet 3012 accounts for less than 35% of the original volume of the center magnet, the product performance is improved. When the hollowed-out volume of the center magnet 3012 exceeds this range, the BL value of the magnetic circuit system sharply decreases. At this time, the increase in the space of the rear cavity 60 has a lower performance improvement effect than the product performance reduction effect caused by the decrease of the BL value of the magnetic circuit system, and the overall performance is the reduction of product performance. Therefore, in the above technical solution provided by the invention, the opening volume of the center magnet should satisfy: the ratio of the opening volume of the center magnet 3012 to the volume of the center magnet 3012 before opening is less than or equal to 35%, and can be further controlled to 5%-30%.

Since the expandable-capacity cavity 200 is located at the center position of the magnetic circuit system 30, under normal circumstances, the rear sound hole on the magnetic circuit system 30 is opened at the corner of the magnetic circuit system 30, that is, the rear sound hole is away from the expandable-capacity cavity 200, and the best capacity expansion effect cannot be achieved, especially when the rear cavity 60 is filled with sound absorbing material, the sound absorbing material at the expandable-capacity cavity 200 is too far away from the rear sound hole, resulting in that the capacity expansion effect of the sound absorbing material at the expandable-capacity cavity 200 cannot reach the best status. Therefore, in a specific implementation, in the case where the recessed groove is formed by a magnet center hole penetrating through the center magnet, a magnetic conductive plate center hole communicating with the magnet center hole may be provided on the center magnetic conductive plate 3011. The magnetic conductive plate center hole communicates the rear cavity 60 and the inner space of the sound generating unit as the second rear sound hole 402. In this embodiment, the four first rear sound holes 401 at the four corners of the magnetic conductive yoke 31 and the second rear sound hole 402 together constitute the rear sound hole 40 provided on the sound generating unit. The magnetic conductive plate center hole here solves the problem that the acoustic resistance of the vibration becomes larger to make the stability of the vibration system becoming worse since the distance between the vibration system and the magnetic circuit of the miniaturized device is small.

Further, as shown in FIG. 1, the rear sound hole 40 of the sound generating unit is provided with a breathable spacer 80 the rear cavity 60 is filled with a sound absorbing material. Specifically, the sound absorbing material may be zeolite material, activated carbon material, or other materials with capacity expansion effect, which is not limited in this patent. The way of providing the breathable spacer 80 directly on the rear sound hole 40 can use all the space of the rear cavity 60 to fill the sound absorbing material, thus increasing the filling amount of the sound absorbing material, and achieving a better capacity expansion effect. Further, combined with the design of the expandable-capacity cavity 200 and the design of the second rear sound hole 402, when the expandable-capacity 200 enlarges the rear cavity 60 and is filled with the sound absorbing material for expansion, the second rear sound hole 402 is located at the center position of the magnetic circuit system and can be increase the contact ratio between the sound absorbing material at the location of the expandable-capacity cavity 200 and the air to achieve the best capacity expansion effect. Therefore, the actual size of the rear cavity 60 can be made as small as possible, which helps to achieve thinner and miniaturized products.

Specifically, as shown to FIG. 2, on the bottom surface of the central magnetic conductive plate 3011 facing the magnetic conductive yoke 31, a breathable spacer 80 covering the magnetic conductive plate central hole is provided. More specifically, a mounting groove recessed in a direction going distally from the magnetic conductive yoke 31 is provided on a bottom surface of the central magnetic conductive plate 3011, and the breathable spacer 80 is mounted in the mounting groove. This prevents the installation of the breathable spacer 80 to occupy the expandable-capacity cavity's space. The breathable spacer 80 includes, but is not limited to mesh cloth to prevent the sound absorbing material at the expandable-capacity cavity 60 from entering the magnetic gap in the magnetic circuit system 30.

In an another achievable solution, the magnetic circuit portion 30 comprises a central magnetic circuit portion 301 and a side magnetic circuit portion 302, the central magnetic circuit portion 301 comprising a central magnet 3012 and a central magnetic conductive plate 3011 provided above the central magnet 3012. The central magnet 3012 is provided with a magnet central hole; the central magnetic conductive plate 3011 is provided with a magnetic conductive plate central hole, and the breathable spacer can also be attached to a side of the central magnetic conductive plate 3011 away from the magnetic conductive yoke 31 and covered on the magnetic conductive plate central hole (not shown).

Furthermore, as shown in FIG. 1, the magnetic conductive yoke 31 is a polygonal structure with tour corners provided with notches; at the corner positions of the magnetic conductive yoke 31, a first rear sound hole 401 is provided at a position near the edge of the notches, of the magnetic conductive yoke 31, and is used to communicate the magnetic gap with the rear cavity 60.

Figure 4:
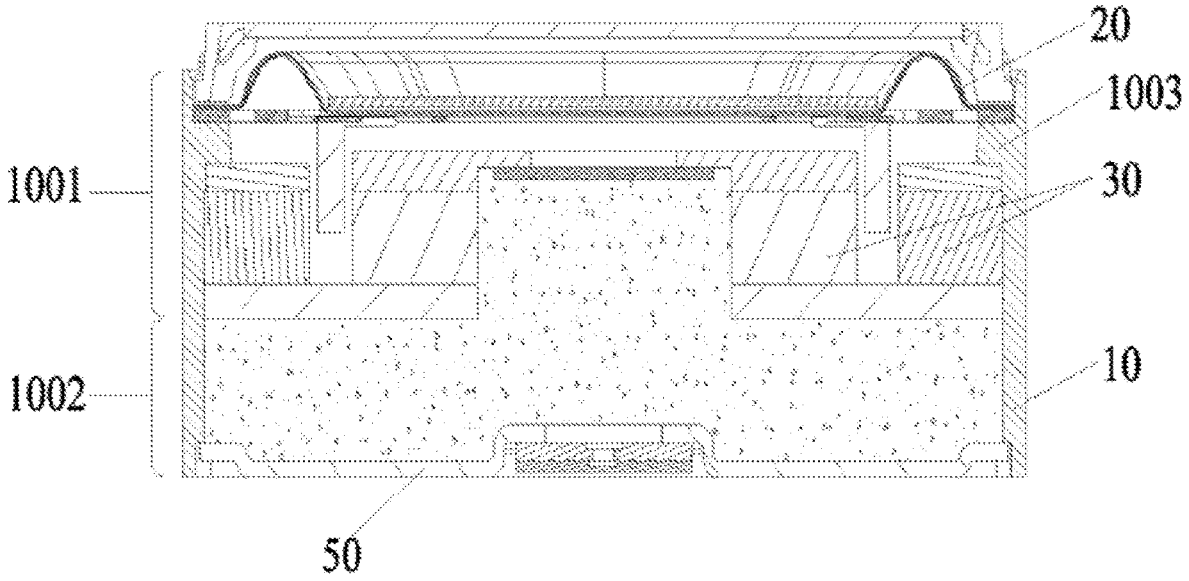
FIG. 4 is a schematic cross-sectional view of a sound generating device provided by an embodiment of the invention.

As shown in FIGS. 1, 2 and 4, the housing 10 is a straight cylinder structure with openings at two ends; the sound generating unit further comprises a vibration system 20, the vibration system 20 comprising a diaphragm 21 and a voice coil 22 fixed below the diaphragm 21, the diaphragm 21 being fixed on an end surface of a first end opening of the housing 10; the magnetic circuit system 30 is disposed below the vibration system 20 and fixed in the housing 10. The housing 10 comprises a first portion 1001 corresponding to the vibration system 20 and the magnetic circuit system 30, and a second portion 1002 integrally extending downward from the first portion beyond a bottom surface of the magnetic circuit system 30; a lower cover plate 50 is mounted at a second end opening of the housing 10, and the rear cavity 60 is formed among the second portion 1002 of the housing 10, the bottom surface of the magnetic circuit system 30, and the lower cover plate 50. In this specific embodiment, the sound generating device is provided with only one housing, and a sufficiently large rear cavity space is directly formed by the lower end portion of the housing, and no additional configuration for forming the module housing of the rear cavity is required, so it does not increase the occupation space in the horizontal direction, which helps to achieve miniaturization of the product, and on the basis of miniaturization, it can take into account the volume of the magnetic circuit system and the volume of the rear cavity, thereby ensuring acoustic performance. Secondly, a rear cavity is arranged directly below the vibration system and the magnetic circuit system, and the rear cavity has a regular shape and is close to the rear acoustic hole. Compared with the prior art, the same large rear cavity volume can achieve a better acoustic effect. In addition, in this embodiment, the design of only one housing can simplify the manufacturing process and installation process, and provide production efficiency.

Further, the outer side of the magnetic circuit system 30 can be disposed in close contact with the inner wall of the housing 10, which can maximize the magnetic circuit system and achieve the miniaturization of the entire sound generating device.

Furthermore, as shown in FIG. 4, an inner wall of a first end of the housing 10 is provided with a convex edge 1003 extending toward a center of the housing 10, and an upper edge of the magnetic circuit system 30 abuts and is fixed on a lower surface of the convex edge 1003.

Figure 5:
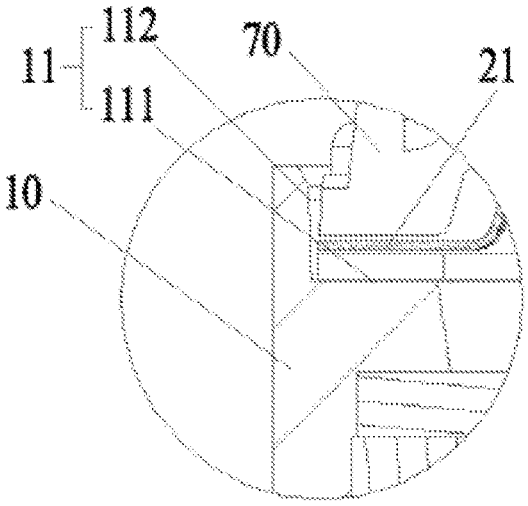
FIG. 5 is a partially enlarged schematic view of FIG. 2.

Specifically, as shown in FIGS. 2 and 5, the housing 10 has a recessed first step end surface 11 at the first end opening, and the first step end surface 11 has a bottom surface 111 and a side surface 112 for mounting the diaphragm 21. The first step end surface 11 can fix and seal the diaphragm well. For example, the fixing portion of the diaphragm 21 is coupled to the bottom surface 111 through the strands, and the edge of the fixing portion of the diaphragm 21 may also be coupled to the side surface 112 through the strands to further fix and seal the diaphragm 21. Referring to FIGS. 1 and 3, an upper cover plate 70 mounted on the housing 10 is further provided above the diaphragm 21, and the edge of the upper cover plate 70 is located inside the side surface 112 of the first step end surface 11.

Figure 6:
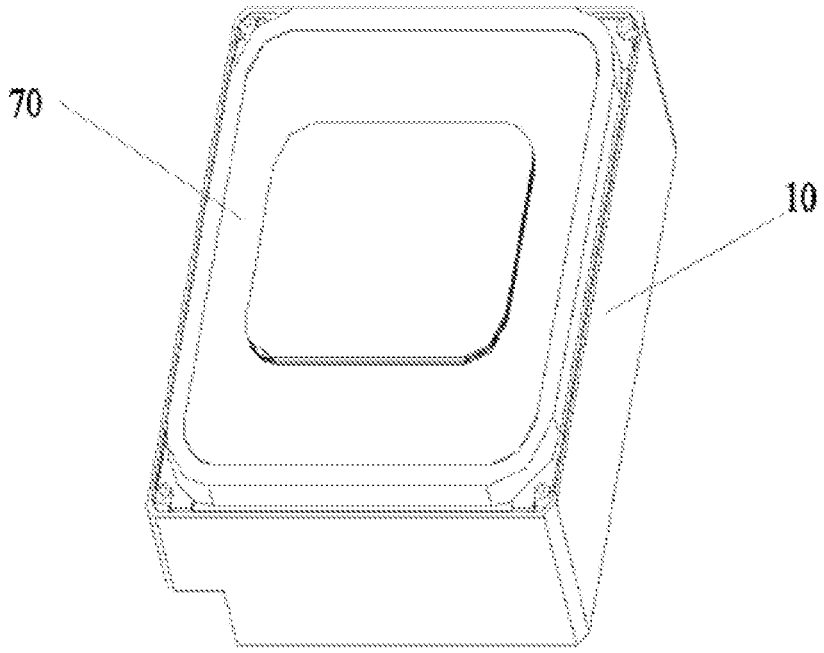
FIG. 6 is a schematic view of a top surface angle of a sound generating device provided by an embodiment of the invention.
Figure 7:
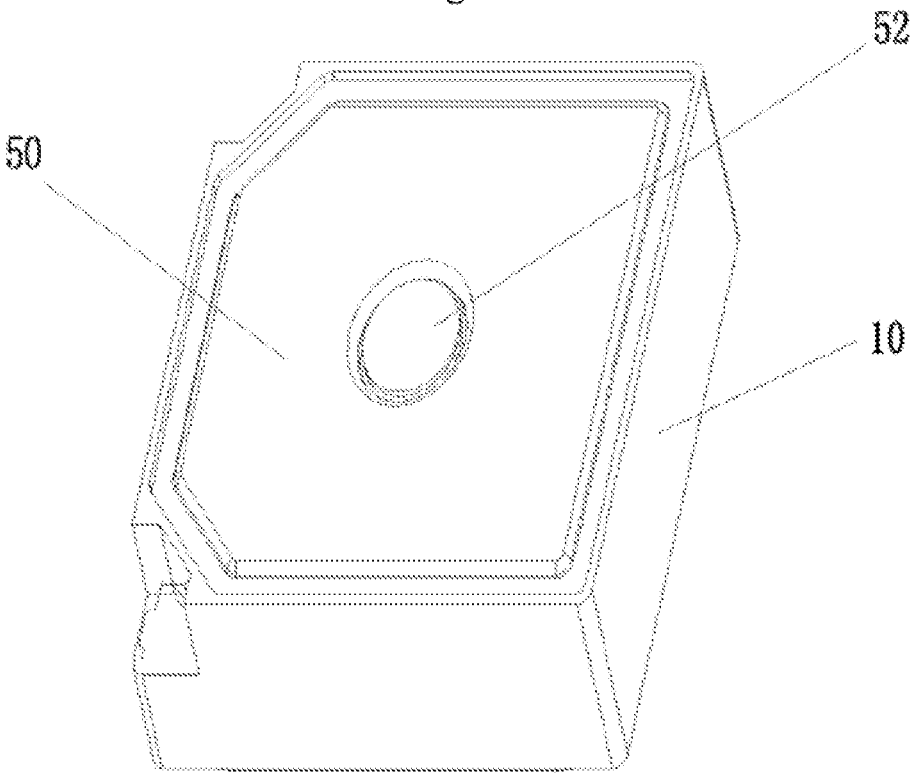
FIG. 7 is a schematic view of a bottom surface angle of a sound generator provided by an embodiment of the invention.

FIGS. 6 and 7 show an outer contour schematic diagrams of an implementation form of a sound generating device provided by an embodiment of the invention. As shown in FIGS. 6 and 7, the housing 10 of the sound generating device provided in this embodiment may be of a rectangular structure. For example, adopting the means that the sound generating device of the technical solution provided by the embodiment of the invention can be prepared to have a plane size of (6-30) mm*(8-30) mm, and then by providing a rear sound hole with a capacity expansion effect on the magnetic circuit system, the purpose of reducing the height dimension of the sound generating device is achieved.

Further, as shown in FIGS. 2 and 7, the rear cavity 60 is filled with a sound absorbing material, the lower cover plate 50 is provided with a filling hole 51 for filling the sound absorbing material, and a cover sheet 52 is encapsulated on the filling hole 51. The cover sheet 52 may be provided with air-permeable micro-holes that allow air to pass and do not allow the sound absorbing material to pass; or, the cover sheet 52 is provided with a leak hole 521, and the leak hole 521 is covered with a first damping mesh 53 that allows air to pass and does not allow the sound absorbing material to pass.

Figure 13:
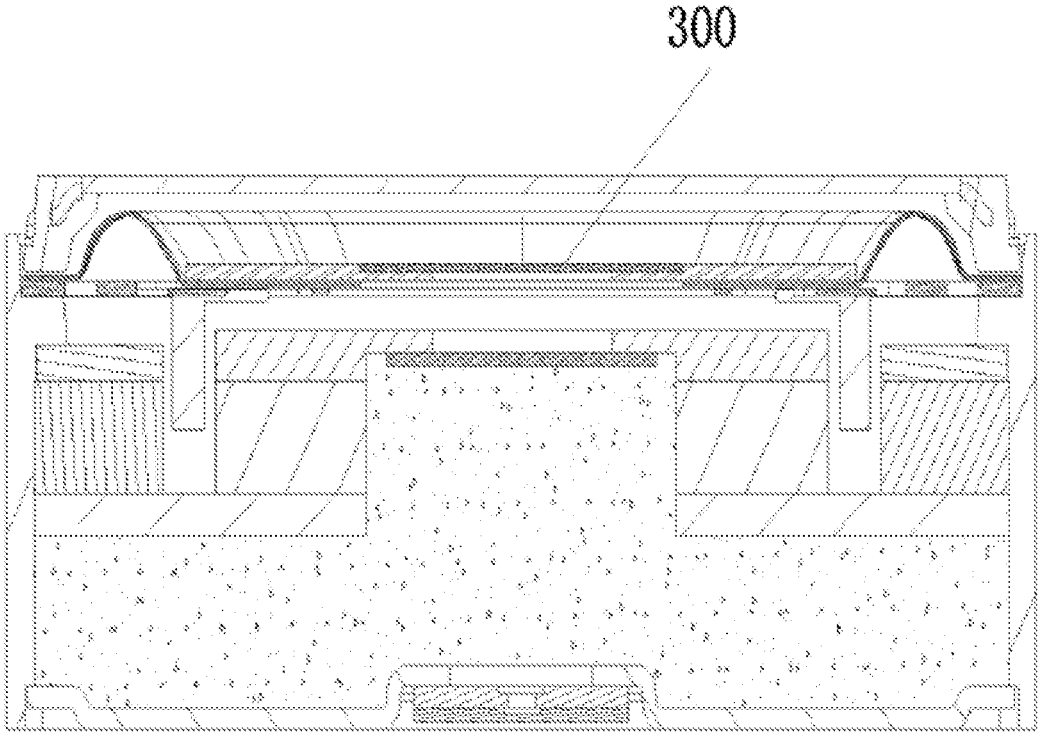
FIG. 13 is a schematic structural view of the opening of the diaphragm system in the sound generating device provided by an embodiment of the invention.

In an actual implementation, a lower cover plate 50 is installed at the second end opening of the housing 10. The lower cover plate 50 in this embodiment may be made of a metal material, which may be made thinner and occupy less space. Further, the lower cover plate is of a flat plate shape (such as the structures shown in FIGS. 8, 9 and 11); or, the lower cover plate 50 is of a bowl-shaped structure provided with a bottom 501 and a side wall 502 (as shown in FIG. 13). In the embodiment in which the lower cover plate 50 is made of metal and is of a bowl-shaped structure, the metal lower cover plate 50 of the bowl-shaped structure has high strength and takes up little space, and the presence of the side wall 502 forms a part of the rear cavity space. Therefore, the height of the housing 10 can be reduced, thereby avoiding the problem that the excessively high plastic housing needs to increase the wall thickness to ensure the overall structural strength, which will increase the occupied space, and is more conducive to miniaturization of the product.

Referring to FIGS. 8-12, in the sound generating device provided in this embodiment, the lower cover plate 50 may be connected to the second end opening of the housing 10 in the following three ways. Of course, the embodiments of the present invention are not limited to the following connection methods.

Figure 8:
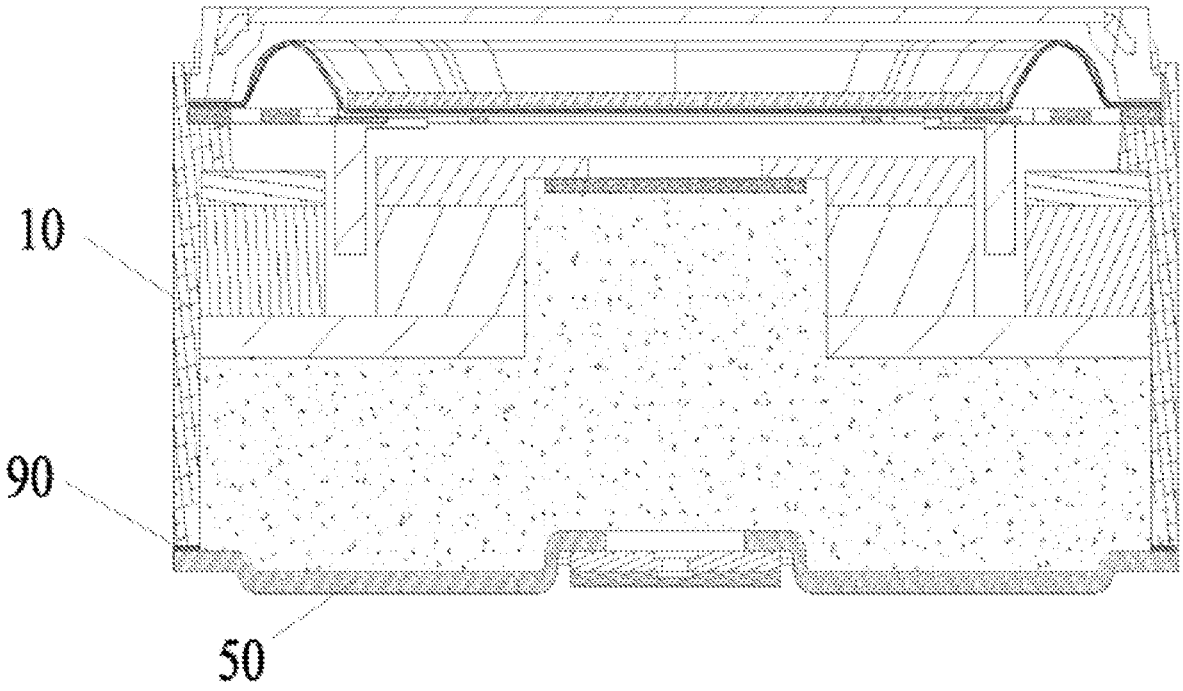
FIG. 8 is a connection structure schematic view of an lower cover plate and a housing in a sound generating device provided by an embodiment of the invention.

In the first way, as shown in FIG. 8, the lower cover plate 50 is bonded to the end surface of the second end opening of the housing 10 through the strand layer 90. Specifically, the edge of the lower cover plate 50 extends to be flush with the outer side wall of the housing 10, and the board surface of the lower cover plate 50 opposite to the end surface of the second end opening of the housing 10 has a back strand. The lower cover plate 50 is bonded to the end surface of the second end opening of the housing 10 through its own back strand to seal the rear cavity.

Figure 9:
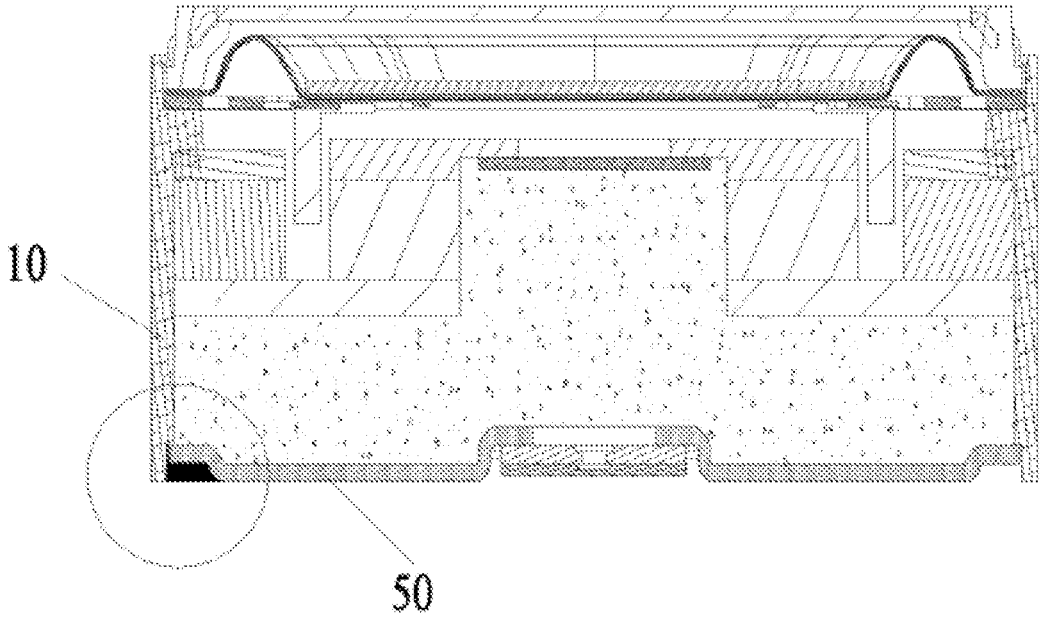
FIG. 9 is an another connection structure schematic view of an lower cover plate and a housing in a sound generating device provided by an embodiment of the invention.
Figure 10:
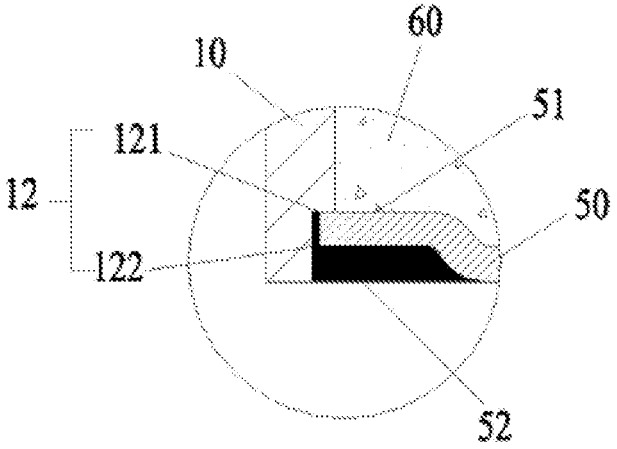
FIG. 10 is a partially enlarged schematic view of FIG. 9.
Figure 12:
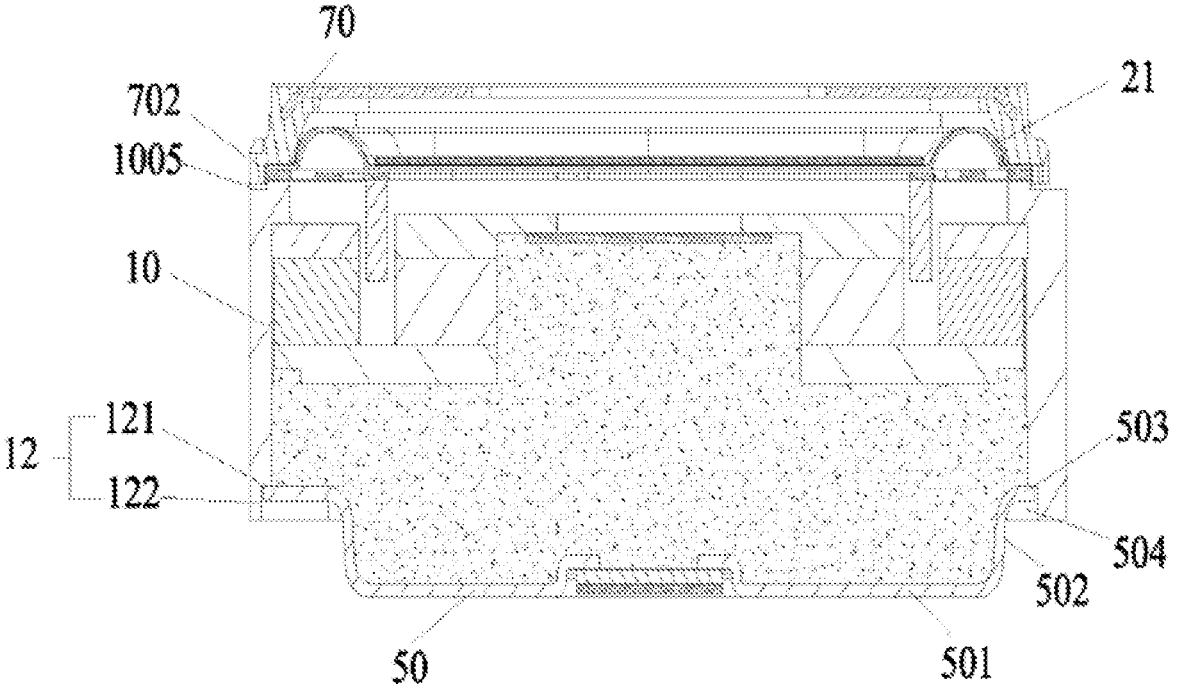
FIG. 12 is a further connection structure schematic view of an lower cover plate and a housing in a sound generating device provided by an embodiment of the invention.

In the second way, as shown in FIGS. 9, and 10, an inner side of the end surface of the second end opening of the housing 10 is provide with a recessed second step end surface 12, the second step end surface 12 is provided with a top surface 121 and side surfaces 122 for mounting the lower cover plate 50; the lower cover plate 50 is of a flat plate shape, an edge of the lower cover plate 50 is provided with a recessed portion 51 recessed toward the rear cavity 60, the recessed portion 51 abuts on the top surface of the second step end surface and 12 and forms a first holding strand groove 52 between the side surfaces of the second step end surface 12, and the first holding strand groove 52 is coated with strands to fix the lower cover plate 50 on the housing 10. Alternatively, as shown in FIG. 12, the lower cover plate 50 is of a bowl-shaped structure provided with a bottom wall 501 and a side wall 502, an end of the side wall 502 of the lower cover plate 50 is bent outward to provide a mounting edge 503, the mounting edge 503 abuts on the top surface 121 of the second step end surface 12 and forms a second holding strand groove 504 between the side surfaces 122 of the second step end surface 12, and the second holding strand groove 504 is coated with strands to fix the lower cover plate 50 on the housing 10.

Figure 11:
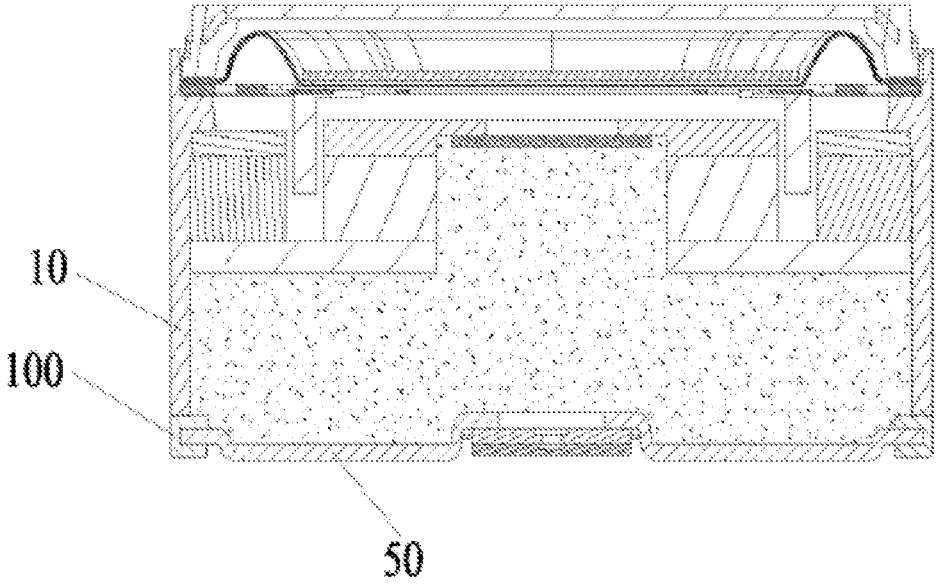
FIG. 11 is a further connection structure schematic view of an lower cover plate and a housing in a sound generating device provided by an embodiment of the invention.

In the third way, as shown in FIG. 11, a plastic edge 100 is injection-molded on a periphery of the lower cover plate 50, and the plastic edge 100 is ultrasonically welded to the second end opening of the housing 10.

In an another specific embodiment, the first end of the housing 10 may be open, and the second end portion of the housing 10 is integrally provided with a housing bottom wall, wherein the housing bottom wall may be all made of a plastic material; or, the housing bottom wall comprises an integrally molded metal sheet for increasing the space.

Figure 14:
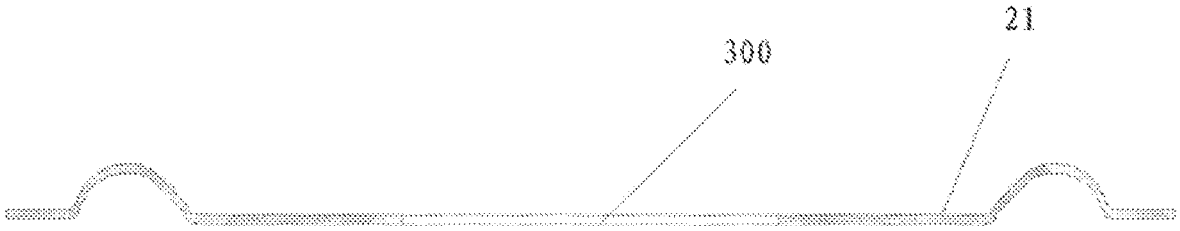
FIG. 14 is a schematic structural view of a diaphragm provided by an embodiment of the invention.
Figure 15:
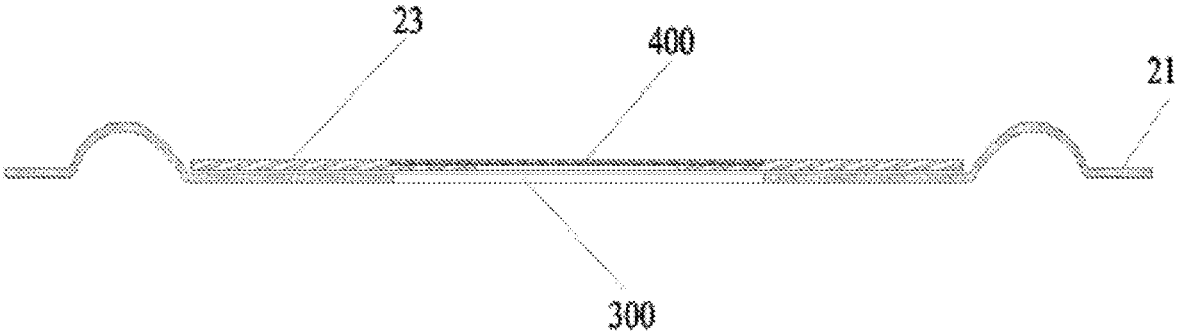
FIG. 15 is a schematic structural view of a diaphragm and a reinforcing portion provided by an embodiment of the invention.

Further, a hole can be made in the diaphragm system, such that when the diaphragm vibrates, the airflow can be ventilated through the upper and lower directions to balance the sound resistance and improve the vibration state of the product. Because it is a waterproof product, the vibration system cannot meet the waterproof requirements after providing the hole. Therefore, adding a waterproof and breathable membrane at the hole can not only improve the vibration state of the product, but also meet the waterproof requirements. Specifically, as shown in FIGS. 13, 14 and 15, the diaphragm 21 comprises a central portion and a folded ring portion disposed around the central portion, a breathable hole 300 is provided in the central portion, and the breathable hole 300 is covered with a second damping mesh 400, the second damping mesh 400 being made of a waterproof breathable material. In addition, the second damping mesh is made of a sound-impermeable material, which can effectively improve the acoustic characteristics of the sound generating device. Providing the hole in the diaphragm can solve the problem that the acoustic resistance of the vibration becomes larger to make the stability of the vibration system becoming worse since the distance between the vibration system and the magnetic circuit of the miniaturized device is small.

In addition, the vibration system may further include a reinforcing portion 23 that is attached to a side of the diaphragm central portion away from the magnetic circuit system 30, and the reinforcing portion 23 is provided a fourth hole at a position facing the breathable hole 300, and the second damping mesh 400 may be attached to the reinforcing portion 23 to cover the fourth hole.

Although some specific embodiments of the invention have been demonstrated in detail by way of examples, it should be understood by a person skilled in the art that the above examples are only intended to be illustrative but not to limit the scope of the invention. It should be understood by a person skilled in the art that the above embodiments can be modified without departing from the scope and spirit of the present invention. The scope of the present invention is defined by the attached claims.

The invention claimed is:

1. A sound generating device, comprising a housing, wherein a sound generating unit is mounted in the housing, a closed rear cavity having a volume is formed between the sound generating unit and the housing, and the sound generating unit is provided with a rear sound hole in communication with the rear cavity, wherein, the sound generating unit comprises a magnetic circuit system and an expandable-capacity cavity provided on the magnetic circuit system, the expandable-capacity cavity acting as part of the rear cavity to increase the volume of the rear cavity.

2. The sound generating device according to claim 1, wherein, the rear sound hole is provided at least at a bottom position or a side position of the sound generating unit.

3. The sound generating device according to claim 1, wherein, the magnetic circuit system comprises a magnetic conductive yoke and a magnetic circuit portion mounted on an upper surface of the magnetic conductive yoke;

a first hole is provided upward at a bottom center position of the magnetic conductive yoke, and a recessed groove communicating with the first hole is provided in the magnetic circuit portion;

the first hole and the recessed groove together form the expandable-capacity cavity.

4. The sound generating device according to claim 3, wherein, the magnetic circuit portion comprises a central magnetic circuit portion and a side magnetic circuit portion, the central magnetic circuit portion comprising a central magnet and a central magnetic conductive plate provided above the central magnet;

the recessed groove is selected from the group consisting of a blind hole disposed in the center magnet and a magnet central hole disposed on the center magnet.

5. The sound generating device according to claim 4, wherein, a ratio of an opening volume of the center magnet to a volume of the center magnet before opening is less than or equal to 35%.

6. The sound generating device according to claim 4, wherein, a magnetic conductive plate central hole communicating with the magnet central hole is provided on the central magnetic conductive plate, the magnetic conductive plate central hole communicating the rear cavity and an inner space of the sound generating unit as the rear sound hole.

7. The sound generating device according to claim 6, wherein, the rear sound hole of the sound generating unit is provided with a breathable spacer;

the rear cavity is filled with a sound absorbing material;

a mounting groove recessed in a direction going distally from the magnetic conductive yoke is provided on a bottom surface of the central magnetic conductive plate, and the breathable spacer is mounted in the mounting groove.

8. The sound generating device according to claim 1, wherein, the rear sound hole of the sound generating unit is provided with a breathable spacer; and the rear cavity is filled with a sound absorbing material.

9. The sound generating device according to claim 8, wherein, the housing is a straight cylinder structure with openings at two ends;

the sound generating unit further comprises a vibration system, the vibration system comprising a diaphragm and a voice coil fixed below the diaphragm, the diaphragm being fixed on an end surface of a first end opening of the housing;

the magnetic circuit system is disposed below the vibration system and fixed in the housing;

the housings comprises a first portion corresponding to the vibration system and the magnetic circuit system, and a second portion integrally extending downward from the first portion beyond a bottom surface of the magnetic circuit system;

a lower cover plate is mounted at a second end opening of the housing, and the rear cavity is formed among the second portion of the housing, the bottom surface of the magnetic circuit system, and the lower cover plate.

10. The sound generating device according to claim 9, wherein, an outer side of the magnetic circuit system is disposed in close contact with an inner wall of the housing.

11. The sound generating device according to claim 10, wherein, an inner wall of a first end of the housing is provided with a convex edge extending toward a center of the housing, and an upper edge of the magnetic circuit system abuts and is fixed on a lower surface of the convex edge.

12. The sound generating device according, to claim 9, wherein, the housing is of a rectangular structure.

13. The sound generating device according to claim 9, wherein, the lower cover plate is provided with a filling hole for filling the sound absorbing material, and a cover sheet is encapsulated on the filling hole.

14. The sound generating, device according to claim 13, wherein, the cover sheet is selected from the group consisting of a sheet provided with air-permeable micro-holes that allow air to pass and do not allow the sound absorbing material to pass;

and a sheet provided with a leak hole, wherein the leak hole is covered with a first damping mesh that allows air to pass and does not allow the sound absorbing material to pass.

15. The sound generating device according to claim 9, wherein, the lower cover plate is made of metal.

16. The sound generating device according to claim 9, wherein, the lower cover plate is selected from the group consisting of a flat plate shape and a bowl-shaped structure provided with a bottom wall and a side wall.

17. The sound generating device according to claim 9, wherein, the lower cover plate is adhered to an end surface of the second end opening of the housing by a strand layer; or an inner side of the end surface of the second end opening of the housing is provided with a recessed second step end surface, the second step end surface being provided with a top surface and side surfaces for mounting the lower cover plate; the lower cover plate is of a flat plate shape, an edge of the lower cover plate is provided with a recessed portion recessed toward the rear cavity, the recessed portion abuts on the top surface of the second step end surface and forms a first holding strand groove between the side surfaces of the second step end surface, and the first holding strand groove is coated with strands to fix the lower cover plate on the housing; or, the lower cover plate is of a bowl-shaped structure provided with a bottom wall and a side wall, an end of the side wall of the lower cover plate is bent outward to provide a mounting edge, the mounting edge abuts on the top surface of the second step end surface and forms a second holding strand groove between the side surfaces of the second step end surface, and the second holding strand groove is coated with strands to fix the lower cover plate on the housing; or a plastic edge is injection-molded on a periphery of the lower cover plate, and the plastic edge is ultrasonically welded to the second end opening of the housing.

18. The sound generating device according to claim 9, wherein, the diaphragm comprises a central portion and a folded ring portion disposed around the central portion, a breathable hole is provided in the central portion, and the breathable hole is covered with a second damping mesh, the second damping mesh being made of a waterproof breathable material.

19. The sound generating device according to claim 18, wherein, the second damping mesh is made of a sound-impermeable material.

* * * * *